US008312576B1

(12) United States Patent
Oh

(10) Patent No.: US 8,312,576 B1
(45) Date of Patent: Nov. 20, 2012

(54) STURDY, COLLAPSIBLE, FOLDING MATTRESS SUPPORT HAVING THE APPEARANCE OF A BOX SPRING

(75) Inventor: Suk Kan Oh, Xiamen (CN)

(73) Assignee: Zinus, Inc., Hayward, CA (US)

( * ) Notice: Subject to any disclaimer, the term of this patent is extended or adjusted under 35 U.S.C. 154(b) by 63 days.

(21) Appl. No.: 13/235,527

(22) Filed: Sep. 19, 2011

(51) Int. Cl.
*A61G 7/00* (2006.01)

(52) U.S. Cl. ..... 5/250; 5/249; 5/174; 5/175; 5/176.1; 5/177; 5/178; 5/179; 5/180; 5/201; 5/202; 5/200.1; 5/400; 5/401; 5/310; 5/285

(58) Field of Classification Search ..... 5/249–252, 5/174–180, 201, 202, 200.1, 400, 401, 310, 5/285
See application file for complete search history.

(56) References Cited

U.S. PATENT DOCUMENTS

| | | | | |
|---|---|---|---|---|
| 1,554,098 | A | 9/1925 | Kaiserman | |
| 2,769,183 | A * | 11/1956 | Froelich | 5/99.1 |
| 4,048,683 | A * | 9/1977 | Chen | 5/180 |
| 4,654,905 | A * | 4/1987 | Miller | 5/249 |
| 4,771,995 | A | 9/1988 | Wells et al. | 267/103 |
| 4,903,949 | A | 2/1990 | Schulz, Jr. | 267/103 |
| 6,076,210 | A * | 6/2000 | Wu | 5/618 |
| 7,363,666 | B2 * | 4/2008 | Polevoy et al. | 5/311 |
| 7,376,988 | B2 | 5/2008 | Wickstrom et al. | 5/174 |
| 7,376,989 | B2 | 5/2008 | Wickstrom et al. | 5/250 |
| 7,406,727 | B2 | 8/2008 | Wickstrom et al. | 5/174 |
| 7,503,086 | B2 | 3/2009 | Wickstrom et al. | 5/250 |
| 2010/0235989 | A1 * | 9/2010 | Jin | 5/174 |

* cited by examiner

*Primary Examiner* — William Kelleher
(74) *Attorney, Agent, or Firm* — Imperium Patent Works; Darien K. Wallace

(57) ABSTRACT

A foldable mattress support is made by covering a metal frame with a fabric covering. The metal frame includes two sections that fold together at two hinges. A first section includes first upper and lower frames, and a second section includes second upper and lower frames. Each of the upper and lower frames is pivotally attached to a hinge. A bolt that is oriented along a first axis passes through the first upper frame and through a plate of the hinge. The first upper frame pivots about a first axis; the second upper frame pivots about a second axis; the first lower frame pivots about a third axis; and the second lower frame pivots about a fourth axis. Each of the axes is orthogonal to the plate, and the third axis is spaced farther apart from the fourth axis than the first axis is spaced apart from the second axis.

22 Claims, 8 Drawing Sheets

STURDY, COLLAPSIBLE, FOLDING MATTRESS SUPPORT HAVING THE APPEARANCE OF A BOX SPRING

TECHNICAL FIELD

The present invention relates to bedding products, and in particular to a collapsible, folding box spring.

BACKGROUND INFORMATION

Conventional beds generally include a mattress resting on a box spring that is supported by a bed frame. Box-springs are generally designed to have the outward appearance of a mattress, being covered by quilted fabric and cushioning, for example. Generally, box springs have a wooden rectangular frame supporting an array of springs to provide firm support for the mattress.

A box spring is typically constructed in one piece having the same dimensions as the mattress it supports. A conventional box spring, due to its stiff wooden frame, is often heavy and awkward to handle. The dimensions of a conventional box spring make it impractical for a consumer to transport the box spring home from a mass-market retail store. For example, the typical box spring does not fit in the trunk of a car. Moving such a box-spring into apartment elevators and around corners into bedrooms is often difficult and exposes the box springs and doorways to potential damage. In addition, the dimensions of a conventional box spring take up valuable floor space which discourages mass-market stores from offering box springs to their retail customers.

Attempts have been made to develop folding box springs. For example, FIG. 1 (prior art) shows a foldable bedding foundation 10 as disclosed in U.S. Pat. No. 7,376,988. Bedding foundation 10 has wire struts 11 that pivotally secure an upper wire grid 12 to wooden rails of the base 13. Wire braces 14 slide along the wire struts 11 and hold the bedding foundation 10 in an erected position when the foundation is unfolded. The two portions of the upper wire grid 12 are connected to each other by an upper hinge 15. Upper hinge 15 is a small piece of plastic that clips onto the border wires of each of the two portions of the upper wire grid 12. The two portions of the base 13 are connected to each other by a lower hinge 16, which is a piece of wire. Upper hinge 15 and lower hinge 16 are not attached to each other. The wire braces that slide along wire struts and the upper wire grids that are clipped together with a plastic hinge render bedding foundation 10 less sturdy than a conventional box spring.

A support for a mattress is sought that provides all of the support, comfort and aesthetic qualities of a conventional box spring but yet that reduces the transportation and storage space requirements of a conventional box spring. Moreover, the novel mattress support should be less flimsy than a foldable bed foundation that employs wire braces, wire struts, wire hinges and wire grids that are clipped together.

SUMMARY

A metal frame that is covered by a fabric covering forms a sturdy, collapsible, foldable mattress support. The metal frame includes a first section and a second section that fold together at two hinges. The first section includes a first upper frame and a first lower frame, and the second section includes a second upper frame and a second lower frame. The first upper frame remains substantially parallel to the first lower frame as the foldable mattress support is unfolded. The foldable mattress support is collapsed when the distal end of the first upper frame is moved adjacent to the distal end of the second upper frame. The first upper frame is substantially parallel to the second upper frame when the foldable mattress support is completely collapsed.

The first upper frame is pivotally attached to both of two hinges and pivots about a first axis. A bolt that is oriented along the first axis passes through the first upper frame and through a metal plate of the first hinge. The first lower frame is also pivotally attached to both of the hinges and pivots about a third axis. The second upper frame is pivotally attached to the hinges and pivots about a second axis, and the second lower frame is pivotally attached to the hinges and pivots about a fourth axis. The first, second, third and fourth axes are orthogonal to the plate of the first hinge and to a plate of the second hinge. The third axis is spaced farther apart from the fourth axis than the first axis is spaced apart from the second axis.

A flat, metal side bar is pivotally attached to both the first upper frame and the first lower frame. The side bar becomes substantially parallel to a side edge of the plate of the first hinge as the foldable mattress support is completely unfolded. The side bar provides structural support to hold up the first upper frame under the weight of a mattress resting on the foldable mattress support. A brace plate is attached to the first upper frame. Although the brace plate rotates with the first upper frame, the brace plate remains perpendicular to the plate of the first hinge. When the foldable mattress support is completely unfolded, the brace plate contacts an upper edge of the plate of the first hinge and prevents the first upper frame from rotating down past a horizontal orientation of the mattress support.

A method of manufacturing a foldable mattress support involves constructing upper and lower frames, attaching the frames to hinges, pulling a covering over the mattress support, folding the mattress support, inserting the mattress support into a packing box and inserting instructions into the packing box that instruct a user of the mattress support to unfold the folded mattress support.

Two upper frames and two lower frames are constructed by welding cross bars between U-shaped peripheral bars. Metal rods are then welded between the cross bars of each of the upper frames. The upper and lower frames are then pivotally attached to both of two hinges by bolts that are oriented along parallel axes. The upper and lower frames are attached at plates of the hinges. The first upper frame pivots about a first axis; the second upper frame pivots about a second axis; the first lower frame pivots about a third axis; and the second lower frame pivots about a fourth axis. Each of the first, second, third and fourth axes is orthogonal to the plates of the hinges. The third axis is spaced farther apart from the fourth axis than the first axis is spaced apart from the second axis. Each of the upper frames is also pivotally attached to the corresponding lower frame by two flat, metal side bars.

Elastic straps are bound from the distal corners of the upper frames to the distal corners of the lower frames. A fabric covering is then pulled over the unfolded metal frame of the mattress support, and the insertion opening in the fabric covering is closed by a zipper.

After the fabric covering is on the mattress support, the first upper frame of the mattress support is folded into the second upper frame of the mattress support. The folded mattress support is then inserted into a packing box. The inside width of the packing box is about four times the width of the bars that form the upper and lower frames plus four times the small thickness of the fabric covering. Finally, instructions are inserted into the packing box that instruct a user of the foldable mattress support how to unfold the folded mattress support.

Further details and embodiments are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

DETAILED DESCRIPTION

Figure 2:
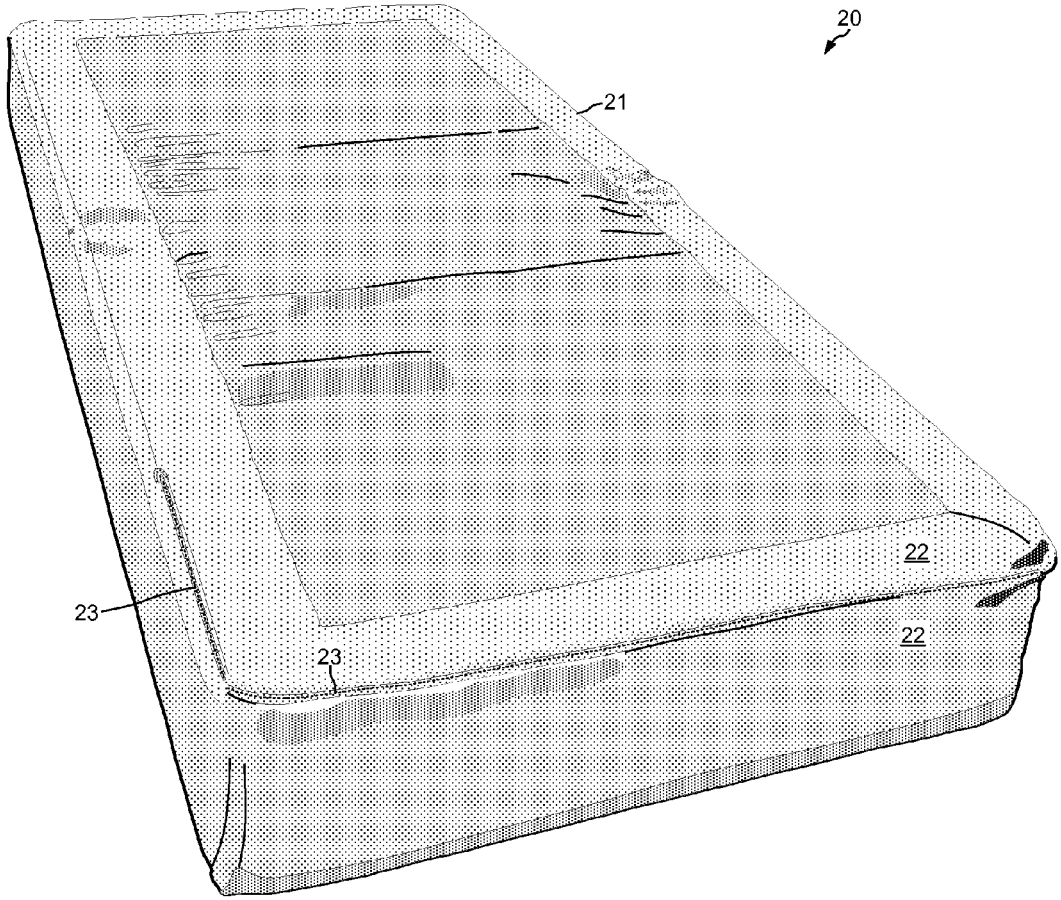
FIG. 2 is a perspective view of a sturdy, collapsible, foldable mattress support that has the appearance of a conventional box spring.

FIG. 2 shows a sturdy, collapsible, foldable mattress support 20 that has the appearance of a conventional box spring. Mattress support 20 has a fabric covering 21. Fabric covering 21 has a border 22 that contains cushioning quilted into the fabric. Fabric covering 21 can be opened using a zipper 23 in order to remove the covering from a metal frame beneath. Thus, fabric covering 21 can be removed, washed in a washing machine, and then placed back over the metal frame.

Figure 3:
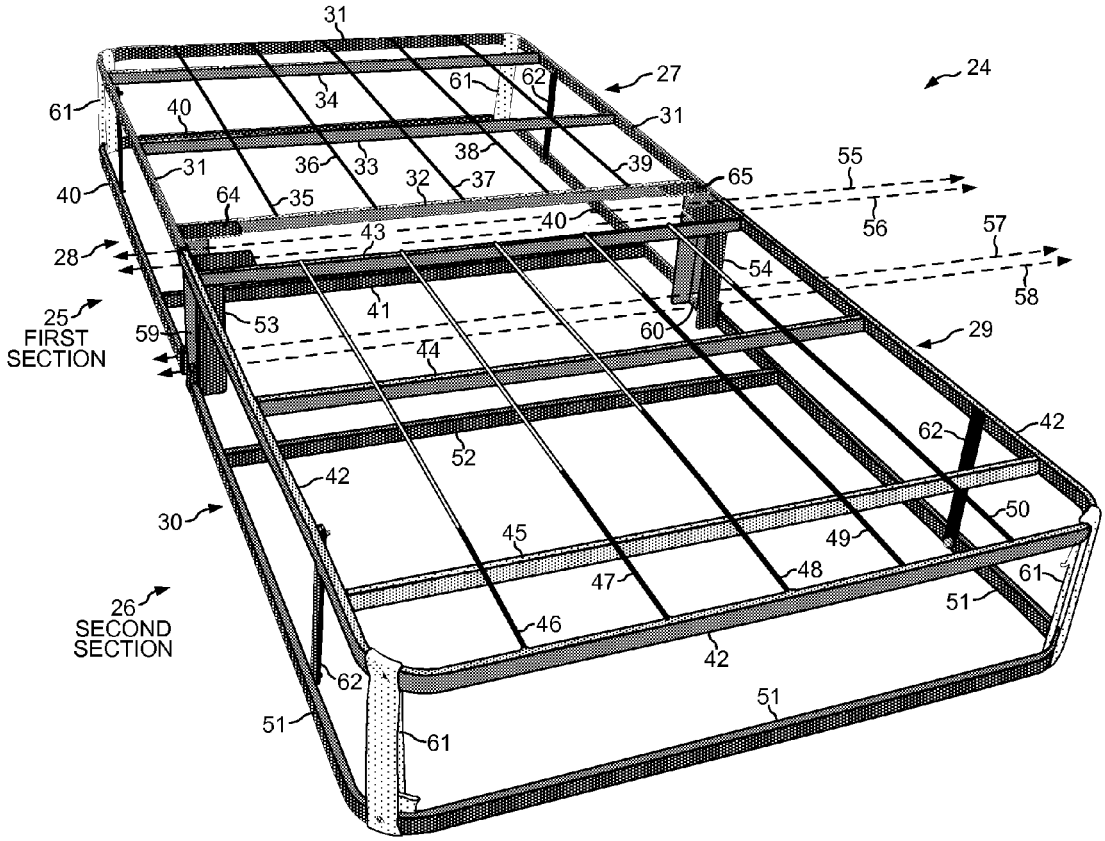
FIG. 3 is a perspective view of the metal frame of the foldable mattress support of FIG. 2 after the fabric covering has been removed.

FIG. 3 shows the metal frame 24 of foldable mattress support 20 of FIG. 2 after fabric covering 21 has been removed. Metal frame 24 is shown in FIG. 3 in a completely unfolded state. Metal frame 24 has a first section 25 and a second section 26 that have been unfolded at center hinges. First section 25 includes a first upper frame 27 and a first lower frame 28. Second section 26 includes a second upper frame 29 and a second lower frame 30. First upper frame 27 includes an upper peripheral bar 31, three upper cross bars 32-34 and metal rods 35-39. In one embodiment, upper peripheral bar 31 and the three upper cross bars 32-34 are hollow and have a rectangular cross section. The hollow, rectangular metal construction of the frames provides a stronger structure with less weight. Metal rods 35-39 are welded over the top of upper cross bars 32-34 and extend to upper peripheral bar 31. Metal rods 35-39 have a solid, circular cross section. First lower frame 28 includes a lower peripheral bar 40 and a lower cross bar 41.

Second upper frame 29 also includes an upper peripheral bar 42, three upper cross bars 43-45 and metal rods 46-50. Upper peripheral bar 42 and cross bars 43-45 also are metal and have hollow, rectangular cross sections. Second lower frame 28 includes a lower peripheral bar 51 and a lower cross bar 52.

Upper peripheral bar 31 of first upper frame 27 is pivotally attached to a first hinge 53 and to a second hinge 54 such that first upper frame 27 pivots about a first axis 55. Upper peripheral bar 42 of second upper frame 29 is pivotally attached to first hinge 53 and second hinge 54 and pivots about a second axis 56. Lower peripheral bar 40 of first lower frame 28 is pivotally attached to first hinge 53 and second hinge 54 such that first lower frame 28 pivots about a third axis 57. Lower peripheral bar 51 of second lower frame 30 is pivotally attached to first hinge 53 and second hinge 54 such that second lower frame 30 pivots about a fourth axis 58.

First hinge 53 includes a first plate 59, and each of first axis 55, the second axis 56, the third axis 57 and the fourth axis 58 is orthogonal to first plate 59. Second hinge 54 includes a second plate 60 that is oriented parallel to first plate 59. Thus, each of the axes 55-58 is also orthogonal to second plate 60.

Elastic straps 61 are bound from the distal corners of upper peripheral bar 31 to the distal corners of lower peripheral bar 40. Likewise, elastic straps 61 are bound from the distal corners of upper peripheral bar 42 to the distal corners of lower peripheral bar 51. Upper peripheral bar 31 is pivotally attached to lower peripheral bar 40 by flat metal side bars 62. The side bars 62 also pivotally attach upper peripheral bar 42 to lower peripheral bar 51. Side bars 62 provide structural support to hold up first upper frame 27 and second upper frame 29 under the weight of a mattress resting on foldable mattress support 20. Elastic straps 61 hold out fabric covering 21 at the corners of foldable mattress support 20 to maintain the appearance of a conventional box spring.

Figure 4:
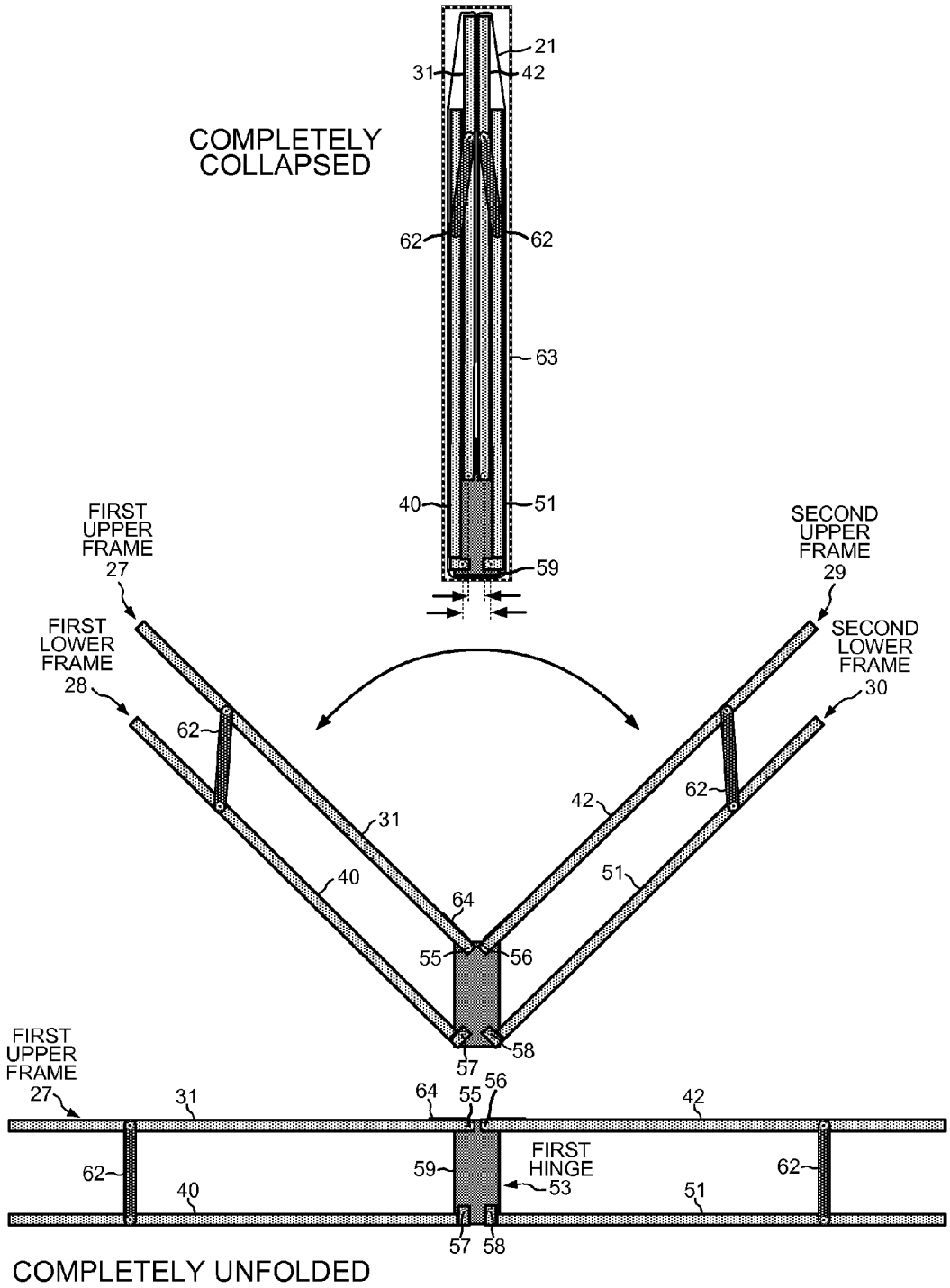
FIG. 4 is a schematic diagram of three side views of the metal frame of FIG. 3 as the mattress support is being unpacked from a packing box and unfolded.

FIG. 4 is a schematic diagram of three side views of foldable mattress support 20 as the support is being unpacked and unfolded. Although fabric covering 21 is not shown in the lower and middle views of FIG. 4, fabric covering 21 covers mattress support 20 above first upper frame 27 and second upper frame 29 and covers the mattress support below first lower frame 28 and second lower frame 30. The lower view of FIG. 4 shows mattress support 20 in a completely unfolded state. FIG. 4 shows that upper peripheral bar 31 of first upper frame 27 is pivotally attached to first hinge 53 by a bolt oriented along first axis 55. (Only axis 55 and not the bolt is labeled in FIG. 4.) FIG. 4 shows that third axis 57 is spaced farther apart from fourth axis 58 than first axis 55 is spaced apart from second axis 56. In addition, each of lower peripheral bar 40 and lower peripheral bar 51 has a short perpendicular extension through which a bolt and the axis of rotation passes. The different spacings of the axes and the perpendicular extensions allow the widths of upper peripheral bar 31 and upper peripheral bar 42 to fit between lower peripheral bar 40 and lower peripheral bar 51 when the upper and lower frames 27-30 are folded up and mattress support 20 is in a completely collapsed state, as shown in the upper view of FIG. 4. When mattress support 20 is collapsed, the distal end of first upper frame 27 is moved adjacent to the distal end of second upper frame 29. Foldable mattress support 20 is delivered in a packing box 63 in the completely collapsed state with fabric covering 21 already pulled over metal frame 24. In the collapsed state in packing box 63, first upper frame 27 is substantially parallel to second upper frame 29.

Figure 1:
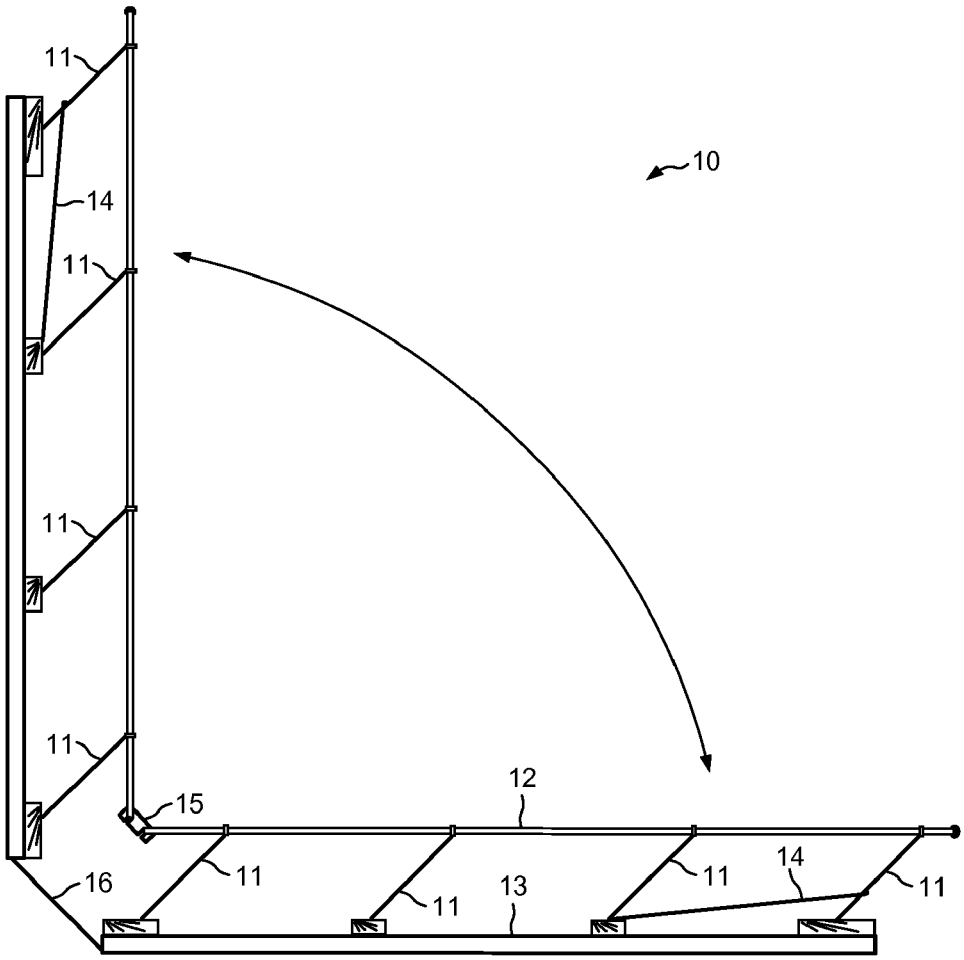
(PRIOR ART) FIG. 1
FIG. 1 (prior art) is a schematic diagram of a foldable bedding foundation that includes wire braces, wire struts, wire hinges and wire grids.

The middle view of FIG. 4 depicts metal frame 24 of foldable mattress support 20 after the support has been removed from the packing box and as the support is being unfolded. First upper frame 27 remains substantially parallel to first lower frame 28 as mattress support 20 is unfolded. The side bars 62 become substantially parallel to the side edges of plate 59 of first hinge 53 as foldable mattress support 20 is completely unfolded. Flat metal side bars 62 are stronger than the wires of the prior-art bedding foundation of FIG. 1 and allow mattress support 20 to form a sturdier base for a mattress. The side bars, peripheral bars and cross bars of mattress support 20 are less likely to squeak than are the wires of the prior-art foundation as a person lying on a mattress above the support moves.

FIG. 4 shows a brace plate 64 attached to first upper frame 27. Brace plate 64 is welded to upper peripheral bar 31 and cross bar 32 and is perpendicular to plate 59 of first hinge 53. When foldable mattress support 20 is completely unfolded as shown in the lower view of FIG. 4, brace plate 64 contacts the upper edge of first plate 59 and prevents first upper frame 27 from rotating down past a horizontal orientation in FIG. 4. A brace plate 65 serves the same function by contacting the upper edge of second plate 60 of second hinge 54. Two additional brace plates prevent second upper frame 29 from rotating down past a horizontal orientation in FIG. 4.

Figure 5:
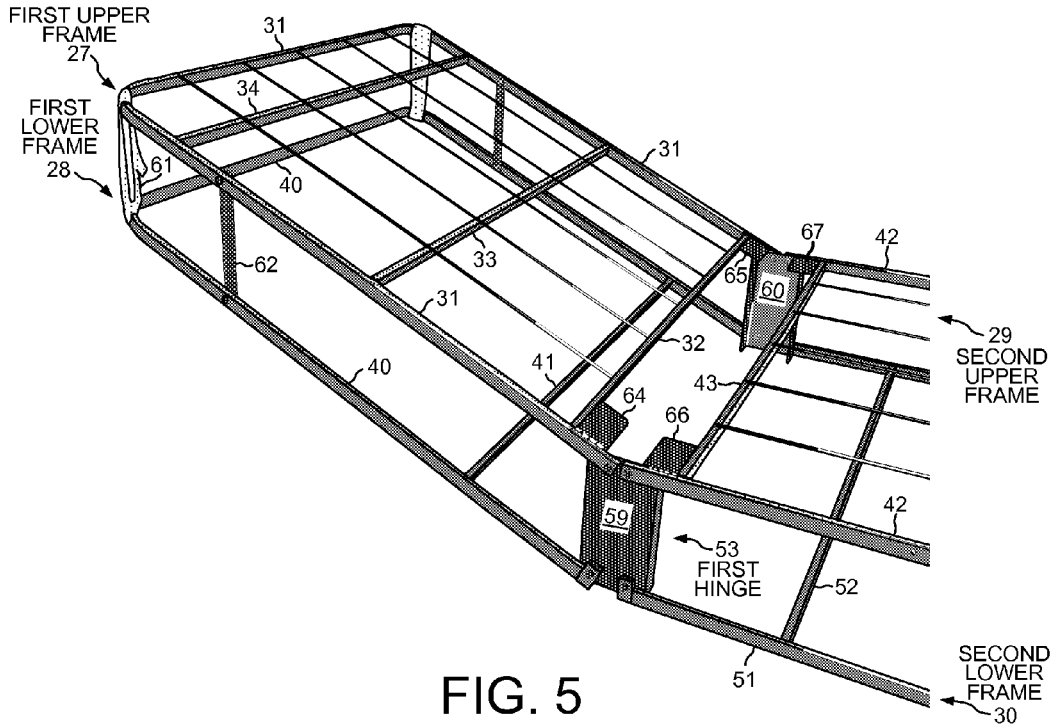
FIG. 5 is a perspective view of the metal frame of FIG. 3 with first upper and lower frames being unfolded and with second upper and lower frames already having been unfolded to a horizontal position.

FIG. 5 is a perspective view of mattress support 20 with second upper frame 29 and second lower frame 30 already unfolded and first upper frame 27 and first lower frame 28 being unfolded. FIG. 5 shows brace plates 66-67 welded to upper peripheral bar 42 and to cross bar 43. Brace plate 66 contacts the upper edge of first plate 59 and prevents second upper frame 29 from rotating down past a horizontal orientation. Likewise, brace plate 67 contacts the upper edge of second plate 60 and prevents second upper frame 29 from rotating down past a horizontal orientation. In FIG. 5, brace plates 64-65 have not yet come to rest on the upper edges of plates 59-60, respectively.

Figure 6:
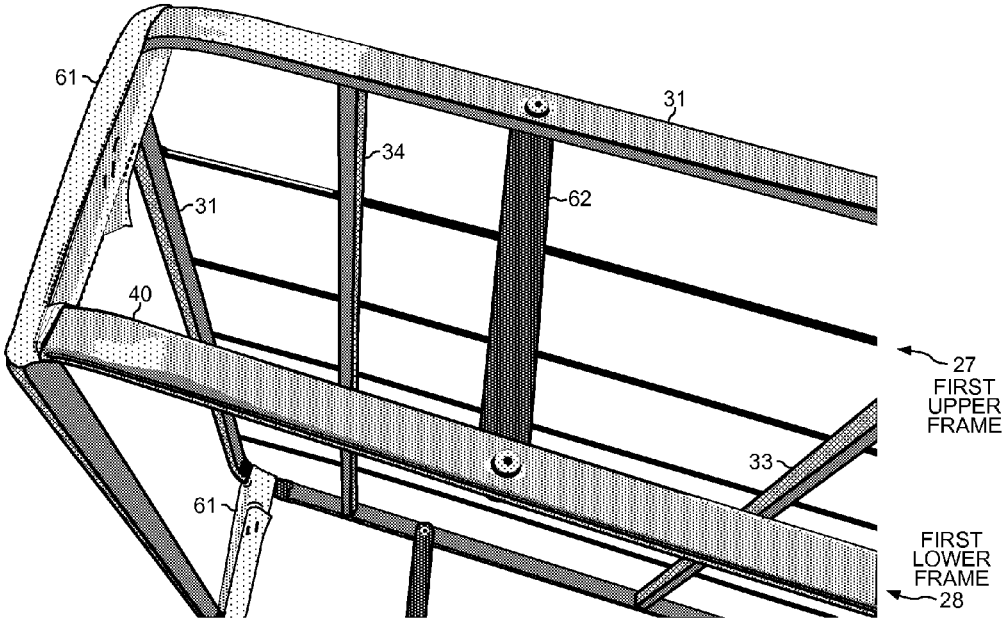
FIG. 6 is a perspective view of elastic straps connecting the corners of distal ends of upper and lower frames of one side of the metal frame of FIG. 3.

FIG. 6 shows the distal ends of first upper frame 27 and first lower frame 28. Elastic straps 61 are wrapped around the corners of upper peripheral bar 31 and lower peripheral bar 40. Each elastic strap 61 is then stapled over to itself to secure it between the peripheral bars.

Figure 7:
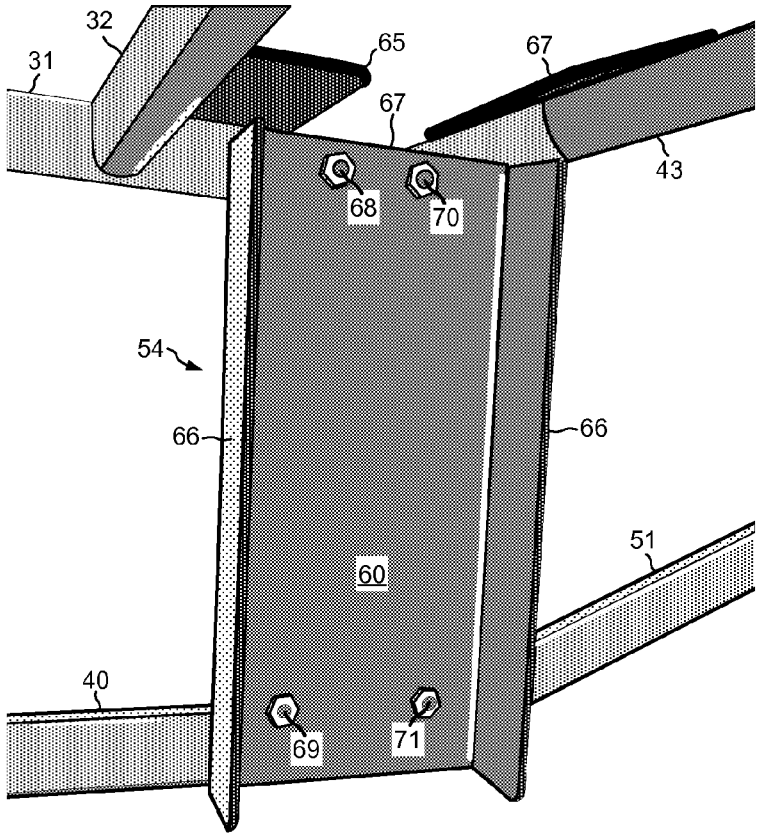
FIG. 7 is a perspective view of the inside surface of a plate of a hinge that connects the upper and lower frames of the metal frame of FIG. 3.

FIG. 7 shows the inside surface of second plate 60 of second hinge 54. Second hinge 54 is a bent piece of sheet metal that includes second plate 60 and two wings 66. In FIG. 7, brace plate 65 is contacting the upper edge 67 of second plate 60 and preventing first upper frame 27 from rotating down past a horizontal orientation. Brace plate 67 has not yet come to rest on upper edge 67 because second upper frame 29 has not yet been completely unfolded. FIG. 7 also shows a bolt 68 by which first upper frame 27 is pivotally attached to second plate 60. Bolt 68 is oriented along first axis 55. In a similar fashion, bolts 69-71 pivotally attach first lower frame 28, second upper frame 29, and second lower frame 30 to second plate, respectively.

Figure 8:
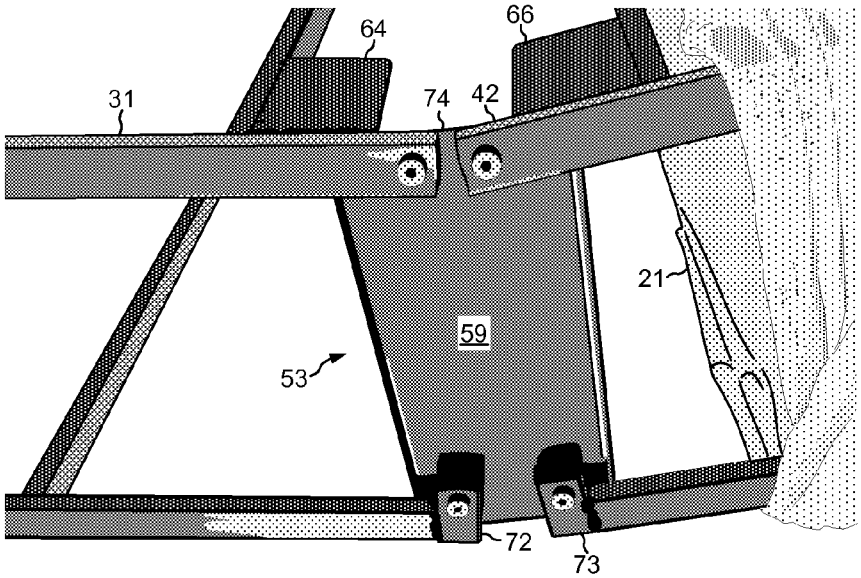
FIG. 8 is a perspective view of the outside surface of a plate of a hinge that connects the upper and lower frames of the metal frame.

FIG. 8 shows the outside surface of first plate 59 of first hinge 53. Fabric covering 21 has been pulled off of first section 25 of metal frame 24 to expose first hinge 53. Short perpendicular extensions 72-73 are welded to lower peripheral bar 40 and lower peripheral bar 51, respectively. The length of the short perpendicular extensions and the greater distance between the bolts that pass through the extensions 72-73 than between the bolts that pass through the upper peripheral bars 31 and 42 allows the widths of upper peripheral bars 31 and 42 to fit between lower peripheral bars 40 and 51 when the upper and lower frames 27-30 are folded up in the completely collapsed state. In FIG. 8, second section 26 is not yet completely unfolded, and brace plate 66 is not yet contacting the upper edge 74 of first plate 59.

Figure 9:
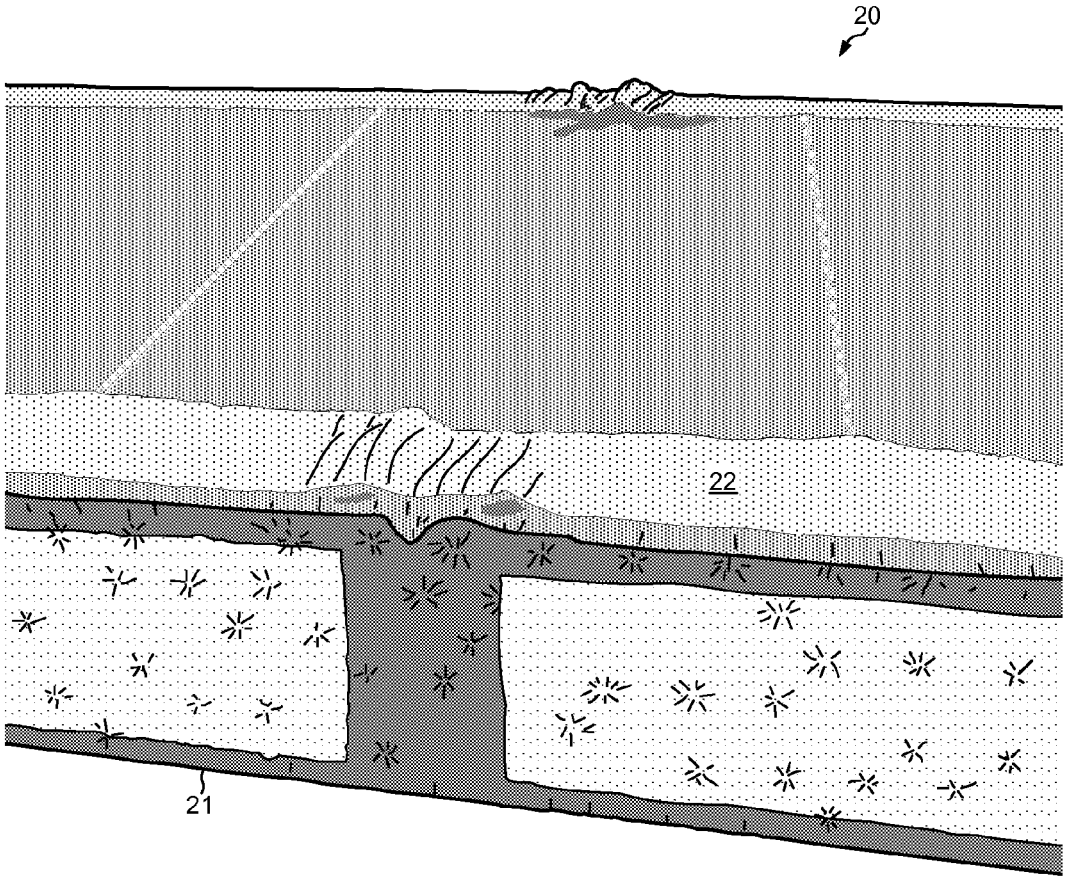
FIG. 9 is a perspective view of the fabric covering that covers the portion of the metal frame of FIG. 3 between the hinges.

FIG. 9 shows the area on fabric covering 21 that covers the portion of metal frame 24 between first hinge 53 and second hinge 54. Border 22 of fabric covering 21 that lies above the hinges 53-54 and brace plates 64-67 is reinforced so as to prevent ripping when foldable mattress support 20 is unfolded and folded. Border 22 bulges a little above the hinges 53-54 because the fabric has been wrinkled by being compressed between upper peripheral bar 31 and upper peripheral bar 42 while mattress support 20 was sitting in packing box 63.

Figure 10:
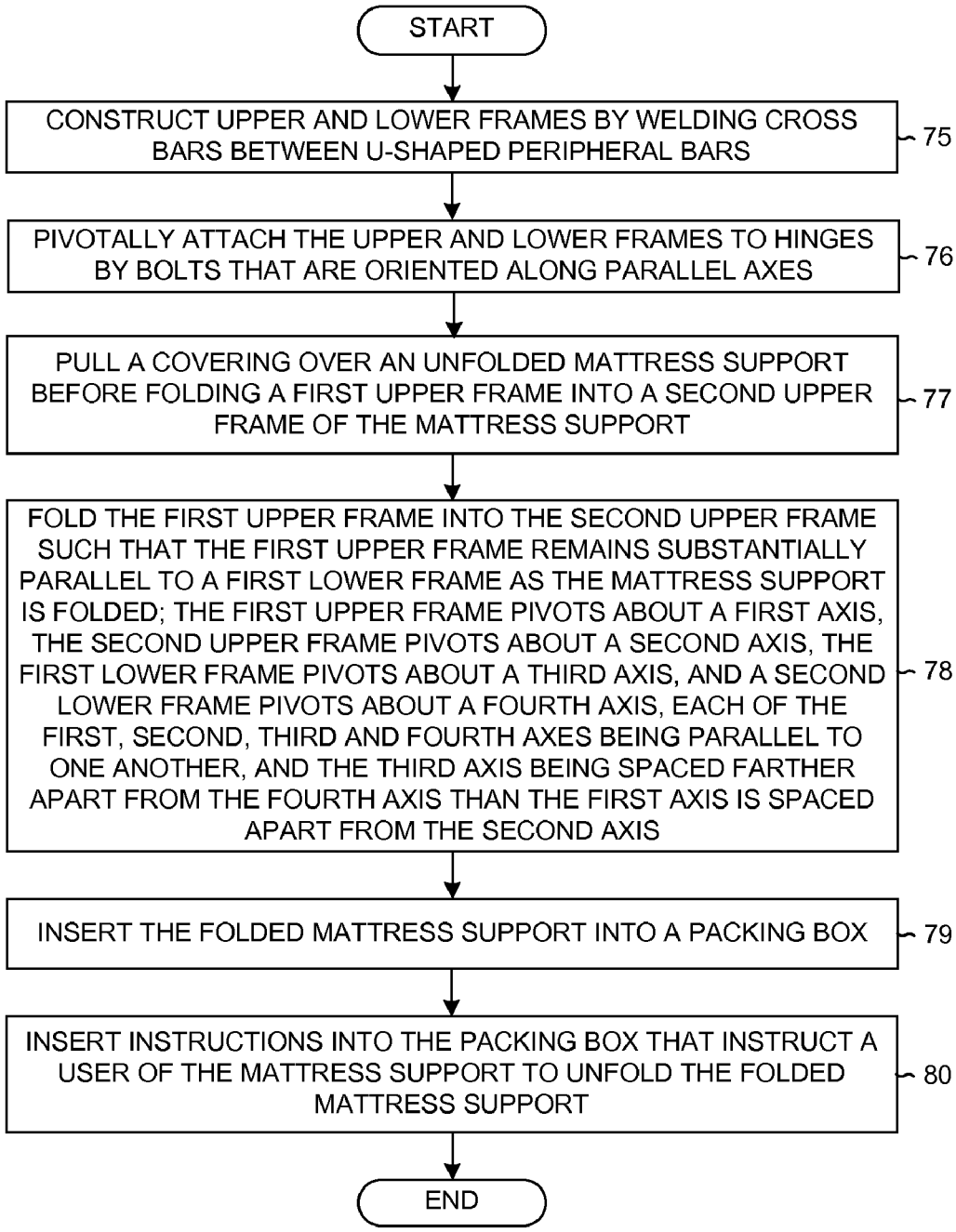
FIG. 10 is a flowchart of steps of a method of manufacturing the foldable mattress support of FIG. 2.

FIG. 10 is a flowchart illustrating steps 75-80 of a method of manufacturing foldable mattress support 20. In a first step 75, first and second upper frames 27, 29 and first and second lower frames 28, 30 are constructed by welding cross bars 32-34, 41, 43-45, 52 between U-shaped peripheral bars 31, 40, 42, 51. In one embodiment, the cross bars and peripheral bars are metal and have hollow, rectangular cross sections. Metal rods 35-39, 46-50 are then welded across the upper cross bars 32-34, 43-45 and upper peripheral bars 31, 42 of each of the first and second upper frames 27, 29.

In a step 76, the first and second upper frames 27, 29 and first and second lower frames 28, 30 are pivotally attached to first and second hinges 53-54. The first and second upper frames 27, 29 are pivotally attached to the first and second hinges 53-54 by bolts 68, 70 that are oriented along parallel first and second axes 55-56. The first and second lower frames 28, 30 are pivotally attached to the first and second hinges 53-54 by bolts 69, 71 that are oriented along parallel third and fourth axes 57-58. The distance between the bolts 69, 71 that attach the first and second lower frames 28, 30 is greater than the distance between the bolts 68, 70 that attach the first and second upper frames 27, 29. The upper frames 27, 29 are attached to the lower frames 28, 30 by flat metal side bars 62. Metal frame 24 of foldable mattress support 20 is formed by pivotally attaching the upper and lower frames by the hinges 53-54 and side bars 62.

In step 77, fabric covering 21 is pulled over unfolded metal frame 24. An opening in fabric covering through which metal frame 24 passes is closed using a zipper.

In step 78, first upper frame 27 is folded up into second upper frame 29 such that first upper frame 27 remains substantially parallel to first lower frame 28 as mattress support 20 is folded. Second upper frame 29 also remains substantially parallel to second lower frame 30 as mattress support 20 is folded, as illustrated in the middle view of FIG. 4.

In step 79, the folded mattress support 20 inside fabric covering 21 is inserted into a cardboard packing box 63. The inside width of the packing box can be as small as about four times the width of a peripheral bar plus four times the small thickness of fabric covering 21. Bolts 68 and 70 are spaced far enough apart to allow room for fabric covering 21 to fit between upper frames 27, 29 when foldable mattress support 20 is completely collapsed.

In step 80, instructions are inserted into packing box 63 that instruct a user of foldable mattress support 20 to unfold the folded mattress support after removing it from the packing box.

By manufacturing the mattress support 20 so that it can fold in half and collapse flat, the mattress support is better suited to sell in mass-market retail stores and can more easily be transported from the store to the location of the mattress to be supported. The large dimensions of a conventional box spring take up valuable floor space in mass-market stores. Less floor space is needed to store and display foldable mattress support 20 on store shelves. The large size and unitary construction of a conventional box spring also make it impractical for a consumer to transport the box spring home from a mass-market retail store. The small packing box 63 containing the collapsed mattress support 20, however, can easily be brought from the store shelf to the check-out counter and then to the trunk of the consumer's car. In addition, the damage that occurs when conventional one-piece wooden box springs are moved through doorways can be avoided. The packing box 63 containing foldable mattress support 20 can more easily be maneuvered up stairs, into apartment elevators and around corners than would a conventional non-collapsible box spring.

Although certain specific embodiments are described above for instructional purposes, the teachings of this patent document have general applicability and are not limited to the specific embodiments described above. Although the peripheral bars and cross bars are described above as being hollow and having rectangular cross sections, foldable mattress support 20 can also be made using peripheral bars and cross bars having other cross sections. For example, the peripheral bars and cross bars can have a solid, circular cross section. Accordingly, various modifications, adaptations, and combinations of various features of the described embodiments can be practiced without departing from the scope of the invention as set forth in the claims.

What is claimed is:

1. A foldable mattress support comprising:

a first section of the mattress support that includes a first upper frame and a first lower frame;

a second section of the mattress support that includes a second upper frame and a second lower frame;

a first hinge that includes a plate, wherein the first upper frame is pivotally attached to the first hinge and pivots about a first axis, wherein the second upper frame is pivotally attached to the first hinge and pivots about a second axis, wherein the first lower frame is pivotally attached to the first hinge and pivots about a third axis, wherein the second lower frame is pivotally attached to the first hinge and pivots about a fourth axis, wherein each of the first axis, the second axis, the third axis and the fourth axis is orthogonal to the plate, wherein the third axis is spaced farther apart from the fourth axis than the first axis is spaced apart from the second axis.

2. The foldable mattress support of claim 1, further comprising:

a second hinge that includes a second plate, wherein each of the first upper frame, the second upper frame, the first lower frame and the second lower frame is pivotally attached to the second hinge, wherein each of the first axis, the second axis, the third axis and the fourth axis is orthogonal to the second plate, wherein the first upper frame is pivotally attached to the first hinge and to the second hinge at the first axis, wherein the second upper frame is pivotally attached to the first hinge and to the second hinge at the second axis, wherein the first lower frame is pivotally attached to the first hinge and to the second hinge at the third axis, wherein the second lower frame is pivotally attached to the first hinge and to the second hinge at the fourth axis.

3. The foldable mattress support of claim 1, further comprising:

a brace plate attached to the first upper frame, wherein the brace plate is perpendicular to the plate of the first hinge, and wherein the brace plate contacts an upper edge of the plate of the first hinge when the foldable mattress support is completely unfolded.

4. The foldable mattress support of claim 1, wherein the first upper frame is pivotally attached to the first hinge by a bolt oriented along the first axis.

5. The foldable mattress support of claim 1, wherein the plate is made of metal.

6. The foldable mattress support of claim 1, further comprising:

a side bar that is pivotally attached to both the first upper frame and the first lower frame, wherein the side bar becomes substantially parallel to a side edge of the plate of the first hinge as the foldable mattress support is completely unfolded.

7. The foldable mattress support of claim 1, wherein the first upper frame remains substantially parallel to the first lower frame as the foldable mattress support is unfolded.

8. The foldable mattress support of claim 1, further comprising:

a fabric covering that covers the foldable mattress support above the first upper frame and the second upper frame and that covers the foldable mattress support below the first lower frame and the second lower frame.

9. The foldable mattress support of claim 1, wherein the first upper frame has a first distal end away from the first hinge, wherein the second upper frame has a second distal end away from the first hinge, and wherein the foldable mattress support is collapsed when the first distal end is moved adjacent to the second distal end.

10. The foldable mattress support of claim 1, wherein the first upper frame is substantially parallel to the second upper frame when the foldable mattress support is completely collapsed.

11. A method comprising:

folding a first upper frame of a mattress support into a second upper frame of the mattress support, wherein the first upper frame is pivotally attached to a plate and pivots about a first axis, wherein the second upper frame is pivotally attached to the plate and pivots about a second axis, wherein a first lower frame is pivotally attached to the plate and pivots about a third axis, wherein a second lower frame is pivotally attached to the plate and pivots about a fourth axis, wherein each of the first axis, the second axis, the third axis and the fourth axis is orthogonal to the plate, and wherein the third axis is spaced farther apart from the fourth axis than the first axis is spaced apart from the second axis; and inserting the folded mattress support into a packing box.

12. The method of claim 11, further comprising:

pulling a covering over the unfolded mattress support before the folding of the first upper frame into the second upper frame.

13. The method of claim 11, wherein a side bar is pivotally attached to both the first upper frame and to the first lower frame, wherein the side bar keeps the first upper frame substantially parallel to the first lower frame as the first upper frame is folded into the second upper frame.

14. The method of claim 11, wherein the first upper frame is pivotally attached to the plate by a bolt oriented along the first axis.

15. The method of claim 11, further comprising:

inserting instructions into the packing box that instruct a user of the mattress support to unfold the folded mattress support.

16. The method of claim 11, wherein the plate is metal, and wherein the mattress support contains no wood.

17. A foldable mattress support comprising:

a first section of the mattress support that includes a first upper frame and a first lower frame;

a second section of the mattress support that includes a second upper frame and a second lower frame, wherein the first upper frame folds into the second upper frame until the first upper frame is substantially parallel to the second upper frame, wherein the first upper frame pivots about a first axis, wherein the second upper frame pivots about a second axis, wherein the first lower frame pivots about a third axis, wherein the second lower frame pivots about a fourth axis, wherein the first, second, third and fourth axes are parallel to one another, and wherein the third axis is spaced farther apart from the fourth axis than the first axis is spaced apart from the second axis; and means for maintaining the first upper frame parallel to the first lower frame as the mattress support is folded, and wherein the means is also for maintaining each of the first, second, third and fourth axes at fixed locations with respect to one another.

18. The foldable mattress support of claim 17, further comprising:

a brace plate attached to the first upper frame, wherein the brace plate contacts the means when the foldable mattress support is completely unfolded.

19. The foldable mattress support of claim 17, wherein the first upper frame has a first distal end away from the means, wherein the second upper frame has a second distal end away from the means, and wherein the foldable mattress support is completely folded when the first distal end is moved adjacent to the second distal end.

20. The foldable mattress support of claim 17, wherein the first upper frame is substantially parallel to the second upper frame when the foldable mattress support is completely folded.

21. The foldable mattress support of claim 1, wherein the first axis, the second axis, the third axis and the fourth axis are fixed with respect to one another.

22. The foldable mattress support of claim 1, wherein each of the first axis, the second axis, the third axis and the fourth axis passes through the plate at a separate fixed location.

* * * * *

US008312576C1

(12) EX PARTE REEXAMINATION CERTIFICATE (10243rd)

United States Patent
Oh

(10) Number: US 8,312,576 C1
(45) Certificate Issued: Aug. 5, 2014

(54) STURDY, COLLAPSIBLE, FOLDING MATTRESS SUPPORT HAVING THE APPEARANCE OF A BOX SPRING

(75) Inventor: Suk Kan Oh, Xiamen (CN)

(73) Assignee: Zinus Inc., Hayward, CA (US)

Reexamination Request:
No. 90/013,047, Nov. 21, 2013

Reexamination Certificate for:

| | |
|---|---|
| Patent No.: | **8,312,576** |
| Issued: | **Nov. 20, 2012** |
| Appl. No.: | **13/235,527** |
| Filed: | **Sep. 19, 2011** |

(51) Int. Cl.
*A61G 7/00* (2006.01)

(52) U.S. Cl.
USPC ..... 5/250; 5/249; 5/174; 5/175; 5/176.1; 5/177; 5/178; 5/179; 5/180; 5/201; 5/202; 5/200.1; 5/400; 5/401; 5/310; 5/285

(58) Field of Classification Search
USPC ..... 5/250, 174, 175, 178, 179, 180, 201, 5/202
See application file for complete search history.

(56) References Cited

To view the complete listing of prior art documents cited during the proceeding for Reexamination Control Number 90/013,047, please refer to the USPTO's public Patent Application Information Retrieval (PAIR) system under the Display References tab.

*Primary Examiner* — Matthew C. Graham

(57) ABSTRACT

A foldable mattress support is made by covering a metal frame with a fabric covering. The metal frame includes two sections that fold together at two hinges. A first section includes first upper and lower frames, and a second section includes second upper and lower frames. Each of the upper and lower frames is pivotally attached to a hinge. A bolt that is oriented along a first axis passes through the first upper frame and through a plate of the hinge. The first upper frame pivots about a first axis; the second upper frame pivots about a second axis; the first lower frame pivots about a third axis; and the second lower frame pivots about a fourth axis. Each of the axes is orthogonal to the plate, and the third axis is spaced farther apart from the fourth axis than the first axis is spaced apart from the second axis.

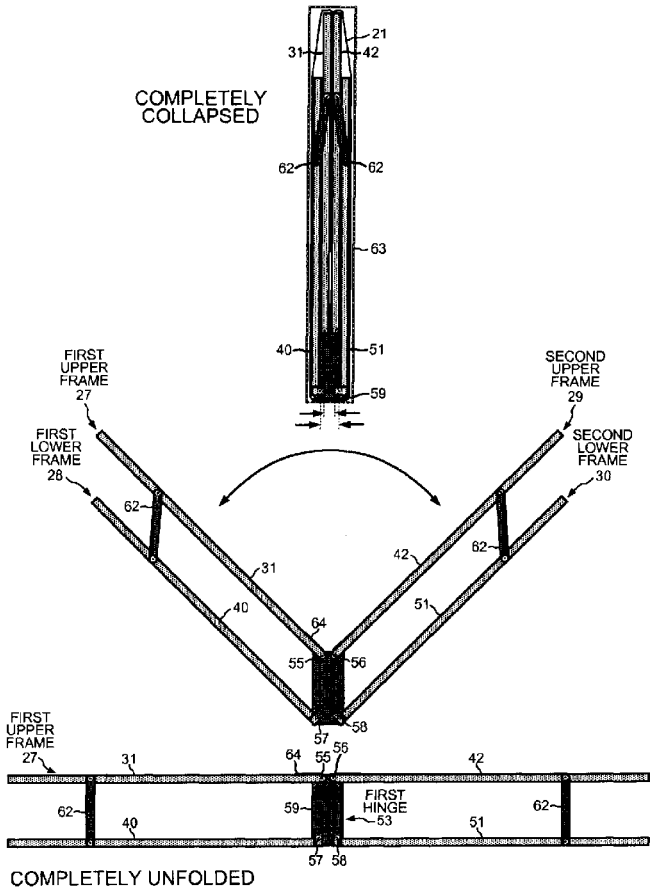

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-22 is confirmed.

* * * * *